United States Patent [19]

Hosooka

[11] 4,411,111

[45] Oct. 25, 1983

[54] WINDOW SASH ASSEMBLY

[75] Inventor: Shuichi Hosooka, Namerikawa, Japan

[73] Assignee: Yoshida Kogyo K. K., Tokyo, Japan

[21] Appl. No.: 201,696

[22] Filed: Oct. 29, 1980

[30] Foreign Application Priority Data

Nov. 13, 1979 [JP] Japan ..... 54-156461[U]

[51] Int. Cl.[3] ..... E06B 1/04

[52] U.S. Cl. ..... 52/213; 49/63; 49/504

[58] Field of Search ..... 52/204, 213; 49/DIG. 1, 49/DIG. 2, 504, 501, 63

[56] References Cited

U.S. PATENT DOCUMENTS

| | | | |
|---|---|---|---|
| 3,208,564 | 9/1965 | Sitterly | 52/213 X |
| 3,289,377 | 12/1966 | Hetman | 49/DIG. 1 X |
| 3,402,510 | 9/1968 | Johnson | 49/504 X |
| 3,984,954 | 10/1976 | Takeda | 49/63 X |
| 4,048,774 | 9/1977 | Yamamoto | 49/63 X |
| 4,055,916 | 11/1977 | Yamamoto et al. | 52/213 X |
| 4,222,200 | 9/1980 | Beirnes | 49/504 X |
| 4,265,052 | 5/1981 | Johnson et al. | 49/501 X |
| 4,285,166 | 8/1981 | Ishida | 49/63 |

*Primary Examiner*—Carl D. Friedman

*Attorney, Agent, or Firm*—Hill, Van Santen, Steadman & Simpson

[57] ABSTRACT

A window sash assembly which comprises an outer metal sash, an inner sash positioned and assembled indoors adjacent to said outer sash and a peripheral edge member positioned about the inner end of said inner sash to cover the adjacent open end of an indoor wall member, is disclosed. Said inner sash includes a main portion of adiabatic material which integrally includes said peripheral edge member at the inner end portion thereof to thereby form a sash main frame extending from said peripheral edge member to the indoor pieces of said outer sash. Metal upper and lower rail frames and metal left-hand and right-hand door boxing frames are positioned along about the inner periphery of said sash main frame. Said sash main frame is formed into a framework and said upper and lower rail frames and left-hand and right-hand door boxing frames are formed into a framework within said framework of the sash main frame.

3 Claims, 8 Drawing Figures

WINDOW SASH ASSEMBLY

BACKGROUND OF THE INVENTION

This invention relates to a window sash assembly comprising an outer sash formed of metal such as aluminum and adapted to be positioned outdoors, an inner sash formed of adiabatic material such as synthetic resin and adapted to be positioned indoors adjacent the outer sash and a peripheral edge member integral with the indoor end of the inner sash for covering the adjacent open end of an indoor wall member.

In the window sash assembly comprising the outer sash and inner sash, it has been known to form the outer sash of metal such as aluminum and the inner sash of adiabatic material such as synthetic resin to improve the adiabatic property of the sash assembly.

However, when the inner sash is formed of adiabatic material such as synthetic resin, there is the disadvantage that the upper and lower rail frames and the door boxing frames which form the inner sash wear out seriously and lack sufficient durability and also it is impossible to provide an inner sash frmework of sufficient strength.

Furthermore, in the recently developed window sash assembly in which the peripheral edge member is positioned about the indoor end of the inner sash to cover the adjacent open end of the indoor wall member, since the abutment ends of the peripheral edge member must be bevelled at 45° and abut against each other to form a square framework, the inner sash and peripheral edge member are generally formed as separate members.

Examples of the window sash assembly of this type are disclosed in Japanese Utility Model Publications Nos. 2055/1979, and 8002/1979 and Japanese Utility Model Laid-Open No. 109633/1976, for example.

However, when the inner sash and peripheral edge member are formed as separate members, since the two members are required to be separately positioned, it makes the mounting of the window sash assembly in a building window opening inefficient.

Furthermore, since the peripheral edge member is required to be positioned about the inner sash, the area where the peripheral edge member and inner sash contact with each other is visible from the inside (indoors) and dust and/or debris tend to accumulate at the contact area to give an unsightly appearance to the sash assembly.

And as disclosed in Japanese Utility Model Laid-Open No. 87640/1979, the window sash assembly has been known in which the peripheral edge member and inner sash are directly connected together to simplify the mounting operation of the sash assembly in a building window opening. However, in the window sash assembly of this type, when the inner sash is formed of adiabatic material, since the inner sash has insufficient strength, the framework provided by the inner sash and peripheral edge member also has insufficient strength and the framework tends to twist and/or deform when the window sash assembly is installed in a building window opening which makes the installation operation difficult.

SUMMARY OF THE INVENTION

Thus, the present invention is to provide a window sash assembly which can effectively eliminate the disadvantages inherent in the conventional window sash assemblies.

One principal object of the present invention is to provide a window sash assembly which has excellent adiabatic property and the inner sash of which has improved durability, which provides a framework of sufficient strength and is easier to install, the completed sash assembly having a pleasing appearance.

The above and other objects and attendant advantages of the present invention will be more readily apparent to those skilled in the art from a reading of the following detailed description in conjunction with the accompanying drawings which show one preferred embodiment of the present invention for illustration purpose only, but not for limiting the scope of the same in any way.

PREFERRED EMBODIMENT OF THE INVENTION

Figure 1:
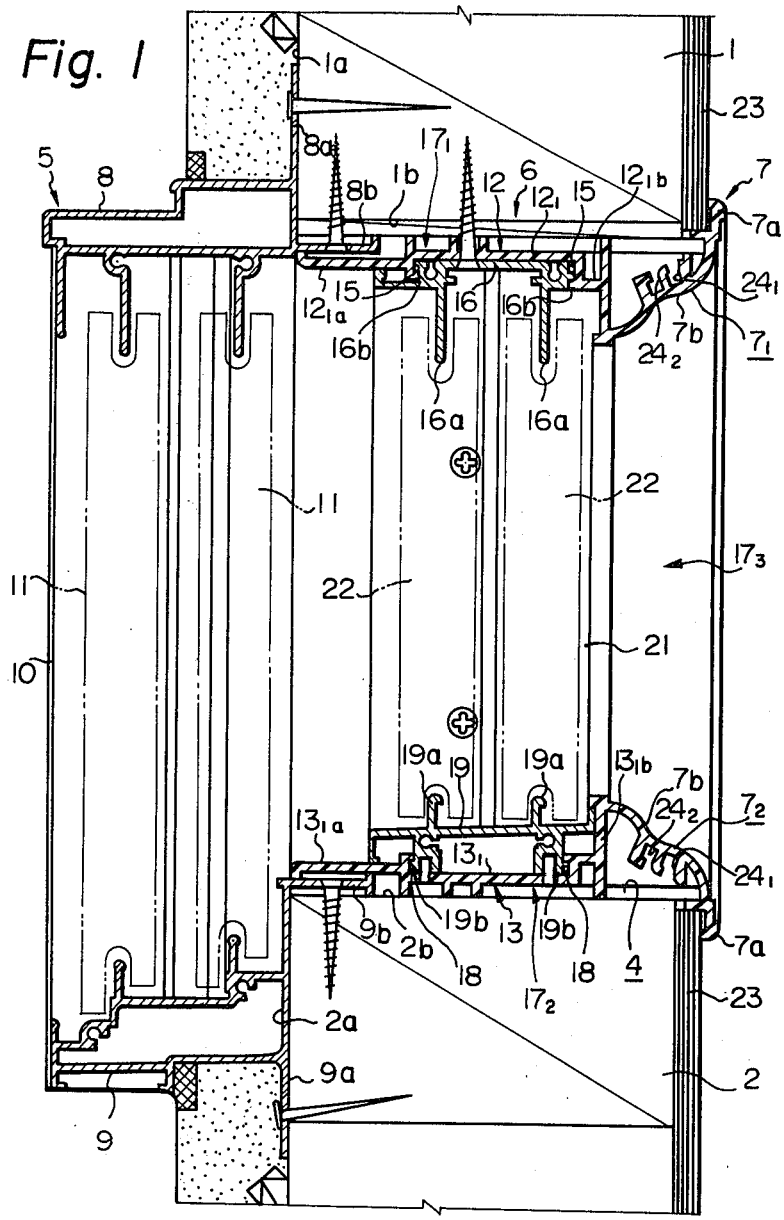
FIG. 1 is a vertically sectional view of the window sash assembly constructed in accordance with the present invention as installed in a building window opening.
Figure 2:
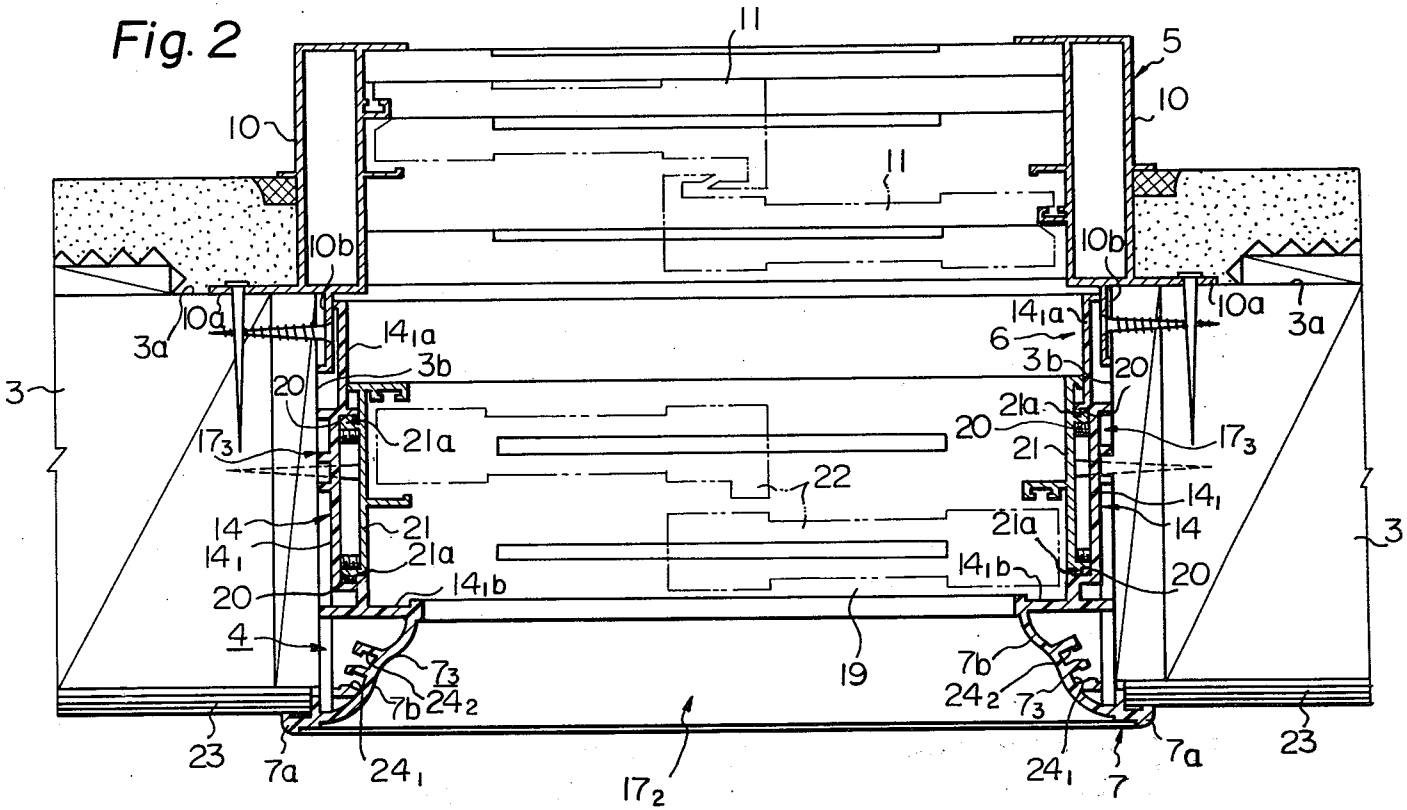
FIG. 2 is a cross-sectional view of the window sash assembly shown in FIG. 1.
Figure 3:
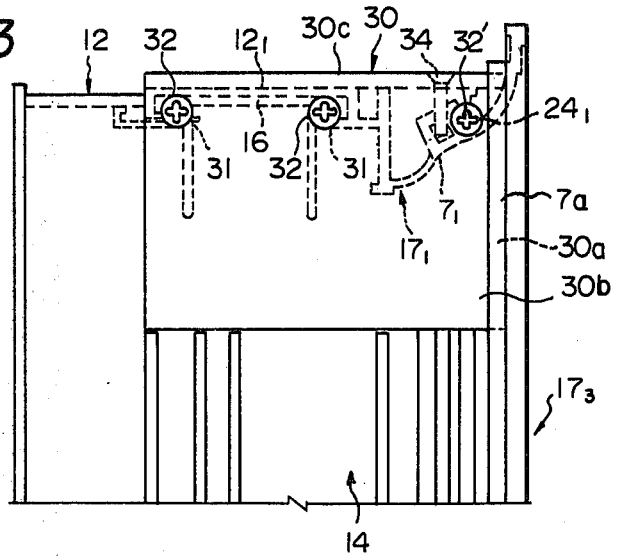
FIG. 3 is a fragmentary front elevational view of the connection between the adjacent corners of the upper frame and vertical frame.
Figure 4:
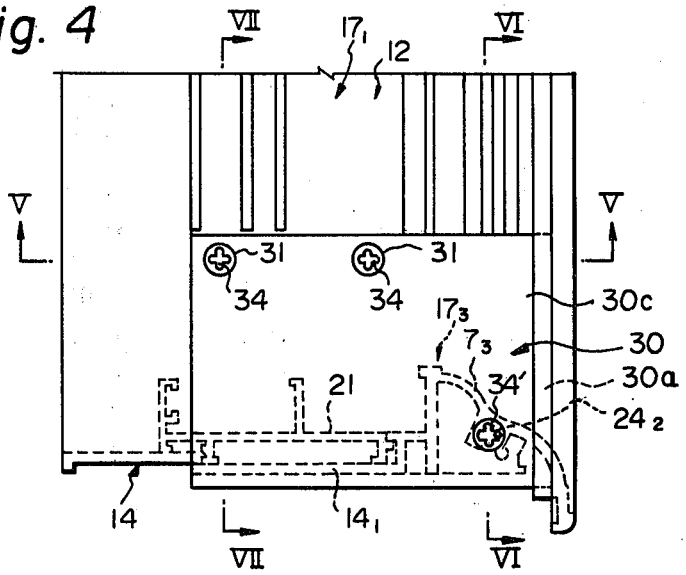
FIG. 4 is a plan view of FIG. 3.
Figure 5:
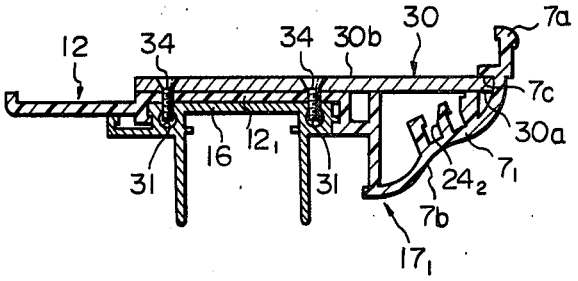
FIG. 5 is a cross-sectional view taken substantially along the line V—V of FIG. 4.
Figure 6:
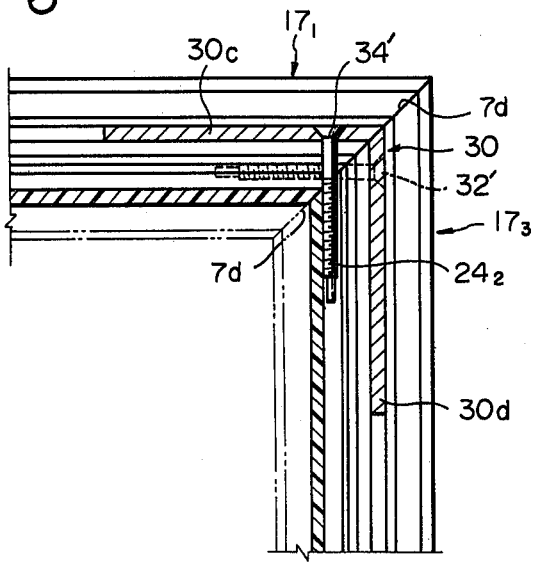
FIG. 6 is a cross-sectional view taken substantially along the line VI—VI of FIG. 4.

The present invention will now be described referring to the accompanying drawings which show one preferred embodiment of the invention.

The window sash assembly which essentially comprises an outer sash 5, an inner sash 6 and a peripheral edge member 7 is installed in a building window opening 4 which is defined by a lintel 1, a window platform 2 and a pair of pillars 3, 3.

The outer sash 5 is formed of metal such as aluminum and comprises a horizontal upper frame 8, a horizontal lower frame 9 and a pair of spaced vertical frames 10, 10 extending vertically between and interconnecting the upper and lower frames 8, 9 to provide a square framework. The upper frame 8 comprises a vertical mounting piece **8*a* adapted to be secured to the outdoor side 1*a* of the lintel 1 and a horizontal mounting piece 8*b* extending along the lower surface 1*b* of the lintel 1. The lower frame 9 comprises a vertical mounting piece 9*a* adapted to be secured to the outdoor side 2*a* of the window platform 2 and a horizontal mounting piece 9*b* extending along the top surface 2*b* of the window platform 2. The pair of vertical frames 10 each comprises a mounting piece 10*a* adapted to be secured to the outdoor side 3*a* of the associated pillar 3 and mounting piece 10*b* extending along the inside 3*b* of the pillar 3. A pair of sliding doors 11, 11 is slidably received within the outer frame 5**.

The inner sash 6 comprises a horizontal upper frame 12, a horizontal lower frame 13 and a pair of vertical frames 14, 14 extending vertically between and interconnecting the upper and lower frames 12, 13 to provide a square framework. The upper frame 12 includes a main body $12_1$ formed of adiabatic material such as synthetic resin and an upper rail frame 16 formed of metal such as aluminum or the like and engaging an anchoring portion 15 of the main body $12_1$. The upper rail frame 16 has upper rails 16*a*, 16*a* integrally formed therewith and the outer portion $12_{1a}$ of the main body $12_1$ overlaps the horizontal mounting piece 8*b* of the outer sash 5. The inner portion $12_{1b}$ of the upper frame main body $12_1$ is contiguous to and integral with an upper portion $7_1$ of the peripheral edge member 7 to provide an upper sash main frame $17_1$.

Similarly, the lower frame 13 includes a main body $13_1$ formed of adiabatic material and a metal lower rail frame 19 engaging an anchoring portion 18 on the lower frame main body $13_1$ and having integral lower rails 19*a*, 19*a*. The outer portion $13_{1a}$ of the main body $13_1$ overlaps the horizontal mounting piece 9*b* of the outer sash 5 and the inner portion $13_{1b}$ of the lower frame main body $13_1$ is contiguous to and integral with a lower portion $7_2$ of the peripheral edge member 7 to provide a lower sash main frame $17_2$.

Similarly, the pair of vertical frames 14, 14 each comprises a main body $14_1$ formed of adiabatic material and a metal door boxing frame 21 adapted to engage and to be secured to an anchoring portion 20 on the vertical frame main body $14_1$. The outer portion $14_{1a}$ of the main body $14_1$ overlaps the mounting piece 10*b* of the vertical frame 10 and the inner portion $14_{1b}$ of the main body $14_1$ is contiguous to and integral with a vertical portion $7_3$ of the peripheral edge member 7 to provide a vertical sash main frame $17_3$. A pair of sliding doors 22, 22 is slidably received in the inner sash 6.

The upper, lower and vertical portions $7_1$, $7_2$, $7_3$ of the peripheral edge member 7 each includes an indoor portion 7*a* covering the adjacent open end of an indoor wall member 23 and an inclined portion 7*b* interconnecting the indoor portion 7*a* and the main body inner portions $12_{1b}$, $13_{1b}$ or $14_{1b}$. The inclined portions 7*b* each has screw receiving recesses $24_1$ and $24_2$ which extend perpendicularly to each other.

In short, the upper, lower and vertical portions $7_1$, $7_2$, $7_3$ which form the peripheral edge member 7 are integrally formed of adiabatic material such as synthetic resin with the main bodies $12_1$, $13_1$ and $14_1$ of the upper, lower and vertical frames 12, 13 and 14 of the inner sash 6, respectively, and these main bodies $12_1$, $13_1$ and $14_1$ extend outwardly toward the mounting pieces 8*b*, 9*b* and 10*b* of the outer sash 5 respectively, and upper, lower and door boxing frames 16, 19 and 21 of the metal are secured to the inside of the main bodies $12_1$, $13_1$ and $14_1$ to thereby integrally form the inner sash 6 and peripheral edge member 7 and then the inner sash 6 is assembled with the outer sash 5.

In the illustrated embodiment, the upper, lower and vertical sash main frames $17_1$, $17_2$ and $17_3$ have been formed by the employment of the same one mold.

The manner in which the inner sash 6 and peripheral edge member 7 are assembled will be described hereinbelow.

First of all, the upper and lower rail frames 16 and 19 and the left-hand and right-hand door boxing frames 21, 21 are suitably secured to the upper, lower and vertical sash main frames $17_1$, $17_2$ and $17_3$, respectively. To put it more precisely, it is only necessary that the engaging portions 16*b*, 19*b* and 21*a* on the upper and lower rail frames 16, 19 and the door boxing frames 21 be snapped into the anchoring portions 15, 18 and 20 on the upper, lower and vertical sash main frames $17_1$, $17_2$ and $17_3$, respectively or alternatively the engaging portions on the upper and lower rail frames and door boxing frames may be slid into the respectively corresponding engaging portions on the upper, lower and vertical sash main frames, respectively, in the longitudinal direction and attached therebetween respectively.

Next, an L-shaped connector member 30 is applied against the adjacent connection corners of the upper, lower and vertical sash main frames and screws are screwed into the aligned thread holes or recesses formed in the upper, lower and vertical sash main frames $17_1$, $17_2$ and $17_3$, the upper and lower rail frames 16 and 19 and the left-hand door boxing frames 21 through the connector member 30 to connect the components together to provide a square framework assembly.

Thereafter, it is only necessary to fit the inner sash 6 and peripheral edge member 7 of the thus formed square framework assembly into the building window opening 4 from indoors and attach therebetween.

The construction of the framework of the inner sash 6 and peripheral edge member 7 will be described hereinbelow referring to FIGS. 3 to 8 inclusive.

Figure 7:
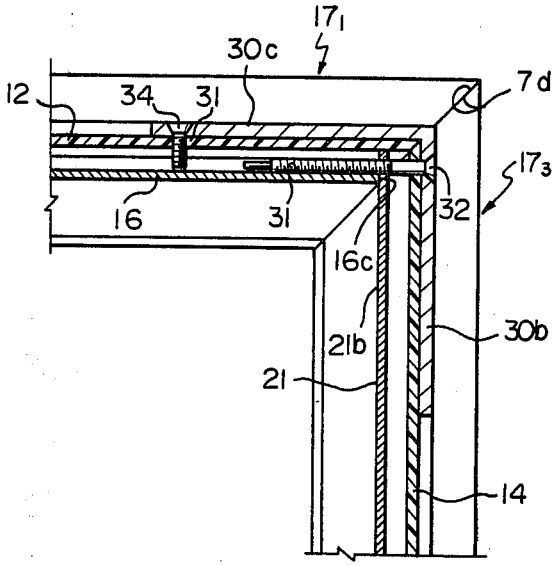
FIG. 7 is a cross-sectional view taken substantially along the line VII—VII of FIG. 4.
Figure 8:
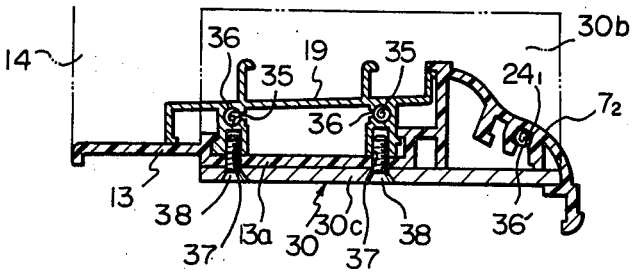
FIG. 8 is a cross-sectional view of the connection between the lower frame and vertical frame.

FIGS. 3 to 7 show the connection between the upper frame 12 and vertical frame 14 in the inner sash 6. The L-shaped connector member 30 is applied against the adjacent corners of the upper frame 12 and vertical frame 16 with the indoor end 30*a* of the member 30 fitted between the engaging portions 7*c*, 7*c* (FIG. 5) on the upper and vertical portions $7_1$ and $7_3$ of the peripheral edge member 7 and the inner end 7*a* of the peripheral edge member 7 protruding outwardly of the connector member 30. Thereafter, screws 32 are screwed into the threaded holes 31 formed in the upper rail frame 16 through the aligned holes (not shown) formed in the vertical leg 30*b* of the L-shaped connector member 30, the vertical frame 14 and the door boxing frame 21, and a screw 32' is screwed into the threaded recess $24_1$ formed in the upper portion $7_1$ of the peripheral edge member through the vertical leg 30*b* of the L-shaped connector member 30 to cause the end face 16*c* of the upper rail frame 16 to abut against the inner side 21*b* of the door boxing frame 21 (FIG. 7). Finally, screws 34 are screwed into the threaded holes 31 formed in the upper rail frame 16 through the aligned holes (not shown) formed in the upper frame 12, and a screw 34' is screwed into the threaded recess $24_2$ formed in the vertical portion $7_3$ of the peripheral edge member 7 to thereby connect the upper frame 12 (the upper sash main frame $17_1$) and the vertical frame 14 (the vertical sash main frame $17_3$) together.

In this way, the adjacent abutment end faces 7*d*, 7*d* of the peripheral edge member 7 which are bevelled at 45° abut precisely against each other and the entire framework is reinforced.

The lower frame 13 and the vertical frame 14 are connected together in a manner similar to that described in connection with the connection between the upper frame 12 and the vertical frame 14. As more clearly shown in FIG. 8, screws 36 are screwed into the thread recesses 35 formed in the lower rail frame 19 through the aligned holes (not shown) formed in the vertical leg 30*b* of the L-shaped connector member 30, the vertical frame 14 and the door boxing frame 21, a screw 36' is screwed into the threaded recess $24_1$ formed in the lower portion $7_2$ of the peripheral edge member 7 through the aligned hole formed in the vertical leg 30*b* of the connector member 30, and screws 38 are screwed into the threaded recesses 37 formed in the lower rail frame 19 through the aligned hole formed in the lower frame 13 to thereby connect the lower frame 13 and the vertical frame 14 together.

With the above-mentioned construction and arrangement of the components of the window sash assembly of the present invention, since the main portion of the inner sash 6 and the peripheral edge member 7 are integrally formed of the adiabatic material, the metal upper and lower rail frames 16, 19 and the metal door boxing frames 21 are connected to the inner periphery of the main portion of the inner sash 6 and the upper and lower rail frames 16, 19 and the left-hand and right-hand door boxing frames 21 are assembled into a framework to thereby form the core for the window sash assembly, notwithstanding the fact that the sash main frame is formed of adiabatic material to improve the adiabatic property of the window sash assembly, the frame assembly is rigid and the strength of the framework provided by the inner sash and peripheral edge member is increased by that of the framework provided by the metal rail frames and door boxing frames. Thus, the window sash assembly can be installed in a stabilized state in the building window opening without twisting and the mounting operation of the window sash assembly is accelerated.

Thus, the window sash assembly of the present invention has improved strength and mounting characteristics as well as improved adiabatic property.

And since the peripheral edge member 7 and inner sash 6 are formed as an integral structure, but not laid one upon another, no dust and/or debris are trapped between the peripheral edge member 7 and the inner sash 6, and the whole has a pleasing appearance. And since the peripheral edge member 7 and inner sash 6 are not required to be positioned relative to each other, the installation of the window sash assembly in the building window opening is accelerated.

And since the upper and lower rail frames 16, 19 and the left-hand and right-hand door boxing frames 21 are formed of metal, the window sash assembly of the invention has improved resistance to wear.

While only one embodiment of the invention has been shown and illustrated in detail, it will be understood that the same is for illustration purpose only and not to be taken as a definition of the invention, reference being had for that purpose to the appended claims.

What is claimed is:

1. A window sash assembly for installation in a building window opening which comprises an outer metal sash, an inner sash positioned and assembled indoors adjacent to said outer sash and a peripheral edge member positioned about the inner end of said inner sash to cover the adjacent open end of an indoor wall member, characterized in that said inner sash includes a main portion of adiabatic material which is integrally formed with said peripheral edge member at the inner end portion thereof and forms a sash main frame composed of similar upper, lower, right-hand, and left-hand frame members and extending from said peripheral edge member to the indoor pieces of said outer sash and metal upper and lower rail frames and metal left-hand ad right-hand door boxing frames being disposed along the inner periphery of said sash main frame, said sash main frame being formed into a first framework and said upper and lower rail frames and left-hand and right-hand door boxing frames being formd into a further framework, said further framework being separately mounted within and connected to said first framework to form a one-piece framework assembly which is fitted as a unit in said building window opening.

2. The window sash assembly as set forth in claim 1, in which the adjacent ends of said sash main frame are bevelled at 45° and abut against each other to form a framework.

3. The window sash assembly as set forth in claim 1, in which one end each of said upper and lower rail frames and left-hand and right-hand door boxing frames abut against adjacent surfaces of the sash main frame and screws are screwed into threaded recesses in said rail and boxing frames through said sash main frame to support said further framework with the framework of said sash main frame.

* * * * *